US007284497B2

(12) United States Patent
Hill

(10) Patent No.: US 7,284,497 B2
(45) Date of Patent: Oct. 23, 2007

(54) SWING MOORING PONTOON

(76) Inventor: Gregory Davis Hill, 409D Mount Browne rd., Coffs Harbour, NSW 2450 (AU)

( * ) Notice: Subject to any disclaimer, the term of this patent is extended or adjusted under 35 U.S.C. 154(b) by 0 days.

(21) Appl. No.: 10/502,308

(22) PCT Filed: Jan. 24, 2003

(86) PCT No.: PCT/AU03/00066

§ 371 (c)(1),
(2), (4) Date: Apr. 14, 2005

(87) PCT Pub. No.: WO03/062040

PCT Pub. Date: Jul. 31, 2003

(65) Prior Publication Data

US 2006/0118027 A1 Jun. 8, 2006

(30) Foreign Application Priority Data

Jan. 25, 2002 (AU) ..... PS0165

(51) Int. Cl.
*B63B 35/44* (2006.01)

(52) U.S. Cl. ..... 114/263

(58) Field of Classification Search ..... 114/263, 114/230.1, 293
See application file for complete search history.

(56) References Cited

U.S. PATENT DOCUMENTS 3,695,207 A * 10/1972 Atlas ..... 114/294
4,979,453 A * 12/1990 Sloan et al. ..... 114/263
5,107,784 A * 4/1992 Lacy ..... 114/263
5,297,899 A * 3/1994 Culley ..... 405/219

FOREIGN PATENT DOCUMENTS

GB 2057367 A * 4/1981 ..... 114/263
WO WO90/11220 * 10/1990 ..... 114/263

* cited by examiner

*Primary Examiner*—Stephen Avila
(74) *Attorney, Agent, or Firm*—Shalom Wertsberger; Saltamar Innovations

(57) ABSTRACT

A swing mooring element comprising a modular pontoon (40) configured to enable two vessels (41, 42) to be moored side by side and including an area (49) between the vessels which allows a person to walk between the vessels. The pontoons (67, 68, 69, 70) may also be interconnected to form a mooring assembly wherein each pontoon (67, 68, 69, 70) is capable of mooring at least two boats.

12 Claims, 7 Drawing Sheets

SWING MOORING PONTOON

BACKGROUND

The present invention relates to boat moorings and more particularly relates to improvements in swing moorings suitable for moorings which require a 360 degree sweep thereabout. More particularly the invention relates to a simple swing mooring which enables mooring of two boats abreast but within the same area normally required by one boat.

PRIOR ART

Mooring of boats in public waterways is becoming an increasing problem due to the limitations on available space. Typically boats are moored in marinas or on swing moorings. The invention to be described herein relates to the latter type of moorings. Swing moorings which are usually found in rivers harbors, estuaries, inlets and the like are provided by maritime authorities for lease or purchase by persons such as boat owners, mariner clubs, private and commercial boat owners. A swing mooring will typically comprise a heavy weight such as a concrete block bearing on the sea or river bed a chain connected at one end to said weight and at an opposite end a float on the surface of the water. The chain may be connected directly to the float or to a length of rope which is connected to the float. The length of rope allows a crew member to more conveniently pull the float to the vessel for securing to the anchorage. When the boat is connected to a swing mooring it must have 360 degrees of clearance to swing to face the prevailing wind direction. This means that each boat moored in this way will take up a large area and in locations where hundreds of boats are to be moored this will put limitations on the number of moorings to the point where for a given water area there will be a finite number of moorings. In some waterways there are long waiting lists for swing moorings which are normally leased or bought from the local maritime authority. Moorings are a source of revenue for the government, thus it follows that if the number of moorings per unit area and thus boats per unit area could be increased, not only would there be more mooring space available for boat owners, there would also be a source of increased revenue for the government. There are a variety of mooring devices and apparatuses for mooring boats at jetties, wharves, pontoons and the like. The known systems and devices may be divided into two categories. The first relates to those devices that are used for connecting a boat to its mooring and the second relates to the mooring itself.

As an example of the first category, U.S. Pat. No. 6,213,017 discloses a device for mooring a boat has an elongate handle with proximal and distal ends. The distal end has an eyelet. A flexible mooring line with a first end is joined to the eyelet and a second end is added to join to the boat. The line extends through the eyelet and about an exterior of the handle member to the proximal end to form a loop at the distal end. The size of the loop can be adjusted by feeding more or less of the line through the eyelet. A flexible retaining line is joined to the proximal end and adapted to join to the boat.

As an example of the second category, U.S. Pat. No. 6,105,530 discloses a floating wharf or pier for boat for ship mooring, comprising a body having a hollow structure defining at least one floatation chamber, said at least one floatation chamber being accessible from outside and defining a storage compartment and an upper admittance hatch member through which said at least one storage compartment is accessible.

U.S. Pat. No. 6,273,016 discloses a portable assembly for supporting a watercraft in relation to a surface flooring of a body of water. The assembly includes a support member for supporting the watercraft and an engaging member adapted to be connected to the support member to selectively retain the watercraft in relation to the support member. A securing assembly is operably connected between the support member and the watercraft to provide a compressive loading force therebetween. Preferably, the support member is formed of a substantially rigid construction. The engaging member is adapted to receive the support member in engagement therewith and may be configured to pivotally engage the watercraft. The securing assembly is moveable between a first position and a second position, thus converting a portion of the weight of the watercraft into a compressive load on the support member. The apparatus for supporting a watercraft may also include a retaining member disposed in relation to the support member. The retaining member helps to resist slippage of the support member in relation to the surface flooring of the body of water, when the securing member is disposed in the second position.

U.S. Pat. No. 6,062,158 discloses a Vessel mooring device. The device is a simple and yet efficient device for mooring vessels that floats up and down with the tide on vertical piling which maintains both ends of a mooring line at approximately the same height from the water. This is accomplished by providing a stainless steel cage with upper and lower rings with interior diameters larger than the diameter of the piling. These rings are connected by a plurality of risers. A bail or other securing means is used to secure the end of a mooring line. A bend is provided in each of the risers near the bottom ring so that the risers project outwardly. A floating means having an interior diameter smaller than the diameter of a plane passing through the bends in the risers is slipped over the lower ring and wedges on the risers so that the mooring device can rise and fall with the tide.

U.S. Pat. No. 5,832,861 discloses a boat docking or mooring apparatus having an elongated tubular housing wherein the housing is adapted for positioning between a boat and a dock while providing positive control in two directions. Adjacent each end of the housing a pin is utilized to secure an elongated helical spring within the housing. End caps, each including a pair of spaced apart cable guiding apertures, are provided at each end of the housing. At one end of the housing, a cable, looped though the apertures in an end cap, engages the elongated spring within the housing. In a similar manner, another cable is looped through the apertures of the other end cap and engages the other spring within the housing. In use, either cable is suitable for convenient attachment to a boat cleat or to a dock cleat. During operation, the combination of spring, cables and cable guiding end caps cooperate to dampen sudden boat movements and, even under adverse conditions, to transfer loads away from the spring and cables by achieving a slow load transfer, thereby stabilizing the boat and preventing damage to boat and dock.

U.S. Pat. No. 5,988,087 discloses a pontoon for a boat including a base member and a closure member which are attached to form a U-shaped performance structure and a cylindrical support structure. A foam filled nose cone is connected to front ends of the base member and closure member, and an end cap is connected to the back end thereof to form an air tight chamber in the support structure. The pontoon is connected to a deck of the boat, so that the pontoon contacts the deck along the entire length of the pontoon. None of the prior art devices identified disclose a swing mooring capable of anchoring two vessels side by side such that the radial float area required is the same as the float area for a single vessel.

INVENTION

The present invention provides an improved swing mooring which increases the number of available moorings per unit area in a simple and efficient manner. More particularly the present invention relates to a module for a swing mooring which enables the safe mooring of two vessels in an area which would previously have accommodated only one vessel.

According to one aspect, in its simplest form, a mooring element comprises a pontoon configured to enable two vessels to be moored side by side and including an area between the vessels which allows a person to walk between the vessels.

According to another aspect the present invention provides a mooring assembly comprising a plurality of mooring pontoons each of which are capable of mooring at least two boats.

In its broadest form the present invention comprises:

a water craft mooring capable of anchoring water craft; the mooring comprising at least one mooring element; wherein each element comprises a floating body including a leading end and a trailing end; and wherein at least part of each said element provides a spacer for separating boats attached to said mooring. Preferably, each element is anchored so that each is capable of swinging responsive to wind or current direction.

Each element is subsantially T shaped wherein; a short leg of said T comprises said leading end and a long leg of said T comprises said spacer. One advantage of the T shape is that it imparts lateral and longitudinal stability to the mooring element.

Each element comprises a pontoon including at least one recess formed therein which accommodates at least part of a boat length of a boat attached to the pontoon.

The spacer allows two boats to be connected in spaced apart relationship such that as the mooring swings the boats swing without unwanted engagement with each other.

Outside splayed edges are disposed adjacent the leading end of each said element which are capable of engaging an opposing corresponding splay edge of an adjacent like pontoon. In one embodiment, a trailing edge of one pontoon is capable of engagement with a trailing end of a like pontoon to define a recess capable of accommodating a boat of predetermined length. The recesses which accommodate at least part of a boat length are defined by inside splay edges and a lateral edge of the spacer.

In another embodiment, the pontoons are disposed in alignment so that a trailing end of one pontoon engages a leading end of an adjacent pontoon. In another embodiment at least two pontoons are disposed so that outside splay edges of one pontoon engage opposing outside splay edges of adjacent pontoons such that a longitudinal axis of one pontoon is parallel to but out of alignment with a longitudinal axis of at least one other like pontoon. Pontoons may be arranged so that a trailing end of one pontoon engages a trailing end of an adjacent like pontoon. Typically, the spacer includes opposing faces each of which engage one of said boats.

In another broad form the present invention comprises;

a swing mooring for enabling the anchorage of two boats therefrom; the mooring comprising a floating element having a leading end and a trailing end, intermediate said leading end and said trailing end a spacing element located between said boats to keep said boats spaced apart but disposed in substantially the same orientation; wherein the mooring allows both boats to rotate within the same 360 circumference subtended from said float.

According to a preferred embodiment, the spacing element includes opposing faces each of which engage one of said boats. Preferably said mooring allows both boats to face the prevailing wind direction contemporaneously.

In another broad form the present invention comprises;

a twin berth swing mooring comprising a mooring element arranged to be connected to a mooring anchorage at or near a leading end the mooring element including a spacer to separate two adjacent boats connected to said mooring; the spacer including opposing side faces which each engage one said boats so that said boats are oriented in substantially the same direction.

Preferably, said boats are connected to said mooring element in spaced apart but parallel relationship.

In another broad form the present invention comprises;

a module for use as a swing mooring for enabling the anchorage of two boats thereto; the module being adapted for floatation and including a leading end and a trailing end; and intermediate said leading end and said trailing end a spacing element located between said boats to keep said boats spaced apart but disposed in substantially the same orientation; wherein the module allows both boats to rotate within a 360 circumference subtended from said float.

In another broad form the present invention comprises;

a swing mooring for enabling the anchorage of two boats therefrom; the mooring disposed radially of an anchorage and subtended by a sea bed weight; the mooring comprising a floating element having a leading end and a trailing end, intermediate said leading end and said trailing end a spacing element located between said boats when said boats are connected to said mooring to keep said boats spaced apart but disposed in substantially the same orientation; wherein the mooring element is subtended from a center position defined by said weight.

In another broad form the present invention comprises:

a floating swing mooring and capable of retaining two boats at the same time; the buoy comprising a generally T shaped body including a leading end and a trailing end, wherein the leading end comprises a head which is connected to a tether such as a rope, webbing or chain and the trailing end is free to move in a 360 degrees arc; wherein intermediate said leading end and said trailing end there is provided an arm having opposing outer surfaces which are continuous with a corresponding surface on said head to define recesses either side of said arm which each receive a boat hull; wherein said boat hulls are tied to said arm via cleats located thereon and provide spacing between said boat hulls so as to prevent unwanted contact between said boat hulls and wherein said boat hulls when connected to said arm are disposed in generally the same windward direction such that both boats are able to rotate in unison in an arc 0-360 degrees.

DETAILED DESCRIPTION

The present invention will now be described in more detail according to a to a preferred but non limiting embodiment and with reference to the accompanying illustrations wherein.

Figure 1:
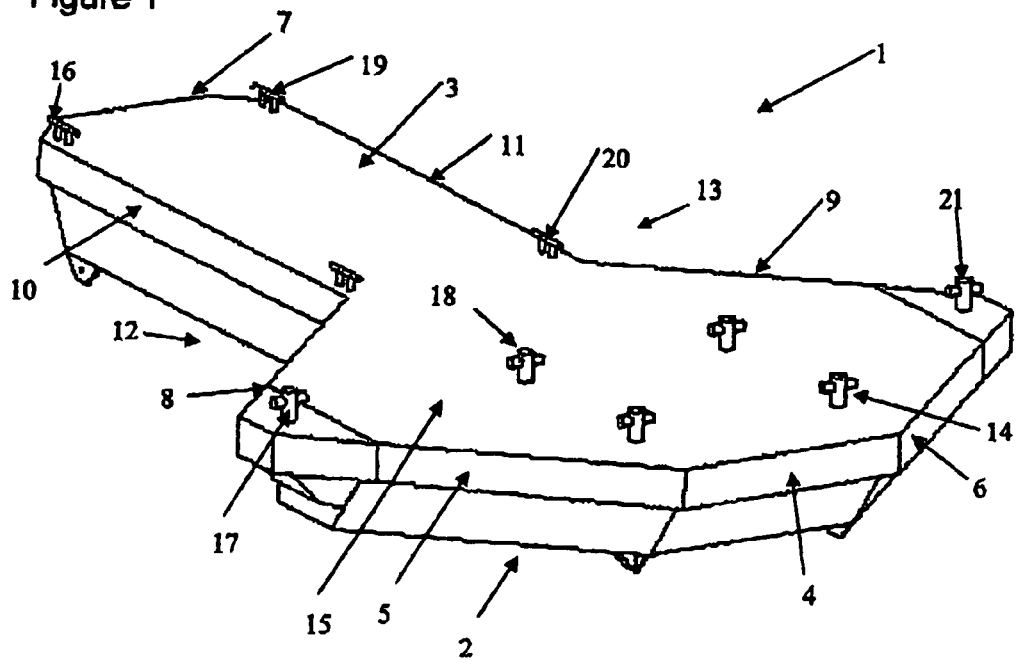
FIG. 1 shows a perspective view of a swing mooring element according to one embodiment of the invention.

Referring to FIG. 1 there is shown a perspective plan view of a swing mooring element 1 according to one embodiment. Element 1 which is adapted for flotation includes a leading head region 2 and a trailing narrower tail region 3. Head region 2 according to one embodiment, includes a leading edge 4, adjacent outside splay edges 5 and 6. Intermediate leading edge 4 and trailing end 7 are inside splay edges 8 and 9. Narrow region 3 is defined by edges 10 and 11 and trailing end 7. Respective edges 8 and 10 and 9 and 11 define respective recesses 12 and 13 which each receive at least part of a boat tied to mooring element 1. Typically a mooring element will include cleats bollards or other means for securing marine vehicles. Mooring element 1 includes bollards or cleats 14 which are distributed across upper surface 15 of mooring element 1 according to particular anchorage requirements. In the case where a boat is moored in recess 12 it will preferably be connected to cleat 16 and bollards 17 and 18. Where a boat is moored at recess 13 it may be connected via cleat 19 and 20 and bollard 21. Selection of anchorage to cleats and/or bollards located on upper surface 15 may depend upon the size of the vessel and the prevailing weather and sea state. Tail region 3 provides a spacer to keep apart adjacent boats which will be moored in recesses 12 and 13.

Figure 2:
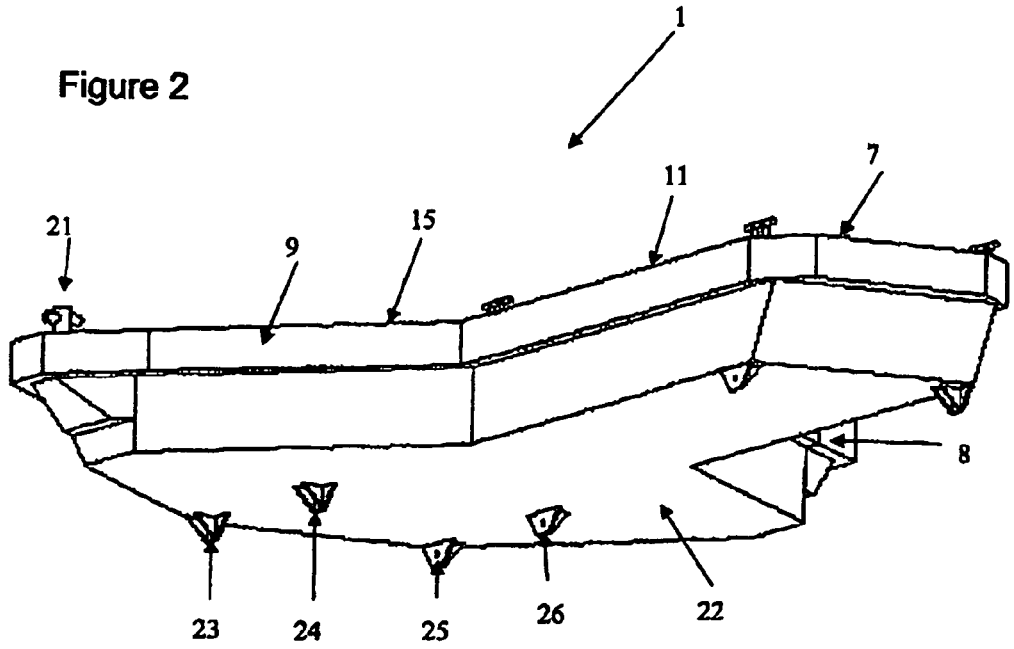
FIG. 2 shows a rear end underside perspective plan view of the mooring element of FIG. 1.

FIG. 2 shows a rear end underside perspective plan view of the mooring element of FIG. 1 with corresponding numbering. Underside surface 22 of mooring element 1 includes anchorages 23, 24 25 and 26 which receive tethers (not shown) which are connected to a spreader plate (see FIGS. 13 and 14). These anchorages are spaced on underside surface 22 of mooring element 1 to ensure that the resultant anchorage force applied to the element is positioned to satisfy stability criteria. Pontoon stability criteria must be satisfied in the free state and when a vessel is moored to the pontoon. In the latter case the boat will alter applied loads to the pontoon. Provided the resultant anchorage force (see FIG. 4) is positioned within an optimal area, stability criteria will be satisfied in both the free state and when a vessel or vessels is/are anchored.

Figure 3:
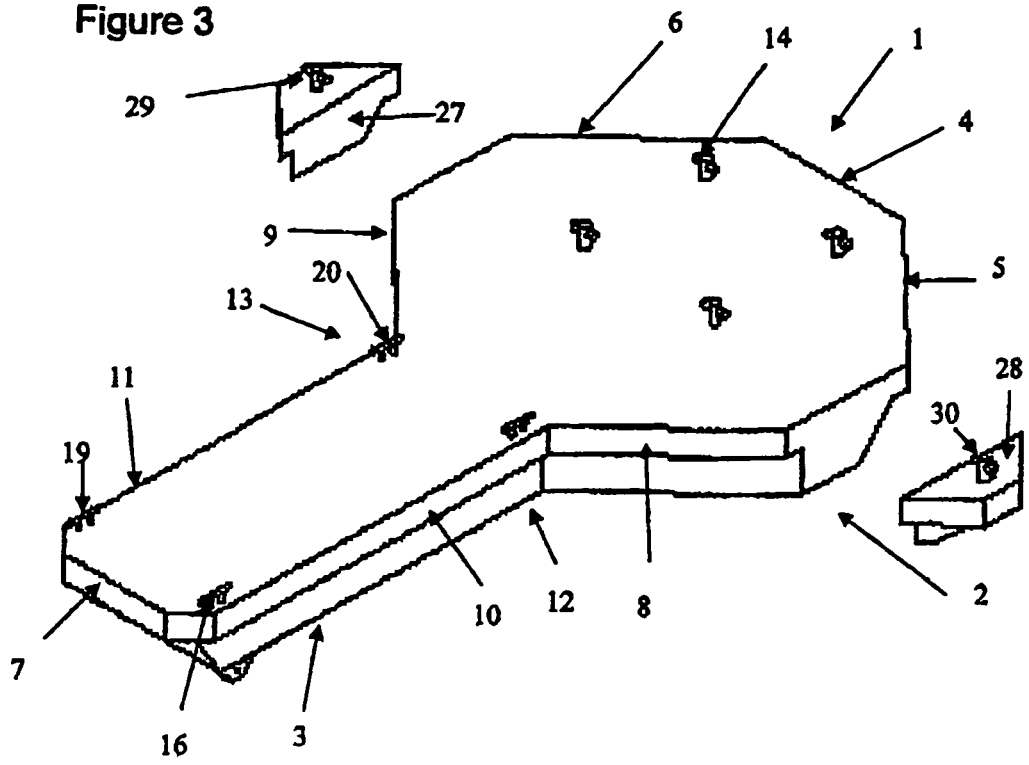
FIG. 3 shows a top perspective view of the mooring element of FIG. 1 with lateral extremities exploded.

FIG. 3 shows an exploded top perspective view of the mooring element 1 of FIGS. 1 and 2 with corresponding numbering. In one embodiment, side elements 27 and 28 can be detachably fixed to leading end 2. Elements 27 and 28 contain respective bollards 29 an 30 which may be replaced in the event of such events as birthing impact, wear or deterioration, by replacement of side elements 27 and 28 which may be exposed to impact damage or wear. Alternatively, removable elements 27 and 28 allow the overall width of the pontoon 1 to be reduced for road transportation. For convenient detachment of elements 27 and 28 a bracket (not shown) may be provided. Preferably elements 27 and 28 are bolted to pontoon 1 in a conventional manner. Alternatively elements 27 and 28 are permanently fixed to pontoon 1.

Figure 4:
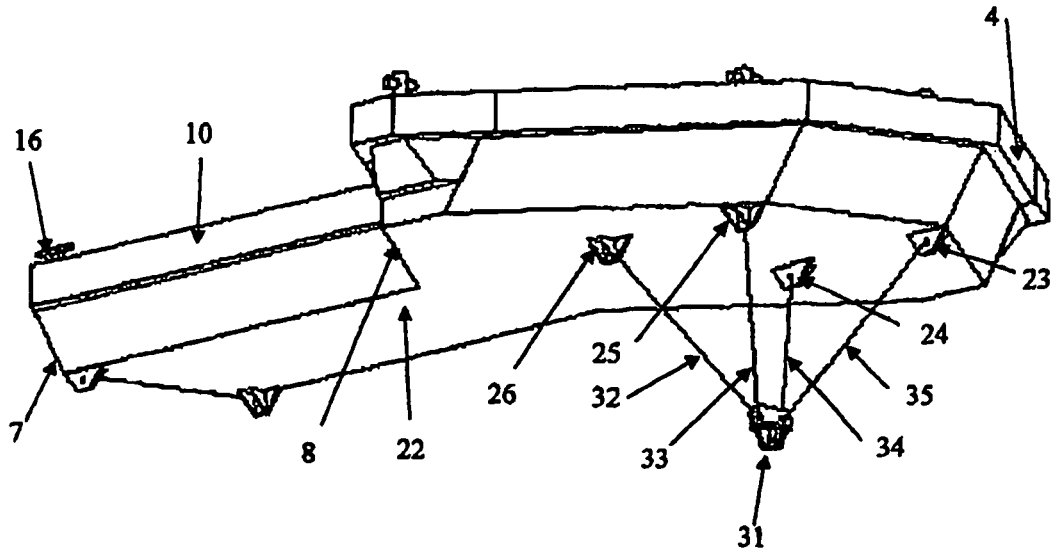
FIG. 4 shows a perspective underside view of the mooring element of FIG. 1 with spreader plate and attachments straps to underside of swing mooring

FIG. 4 shows a perspective underside view of the mooring element of FIG. 1 with spreader plate 31 and attachment straps (webbing) 32, 33, 34 and 35 respectively attached to anchorages 23, 24, 25 and 26 of surface 22. Anchorages 23, 24 25 and 26 will preferably be disposed so that spreader plate 31 will stabilize mooring element 1 such that the resultant downward force will be applied at a location which optimizes stability in the free state and when a vessel is anchored to the pontoon to ensure the mooring element is kept level and not subject to eccentric loading. Spreader plate 31 used with webbing is intended to eliminate galvanic corrosion between the pontoon and anchor chain. This is particularly important when the pontoon is made of alloy.

As an alternative to webbing, chains, ropes or the like may be used. Throughout the specification, a reference to straps may be taken as referring to webbing, chains, rope or the like.

Figure 5:
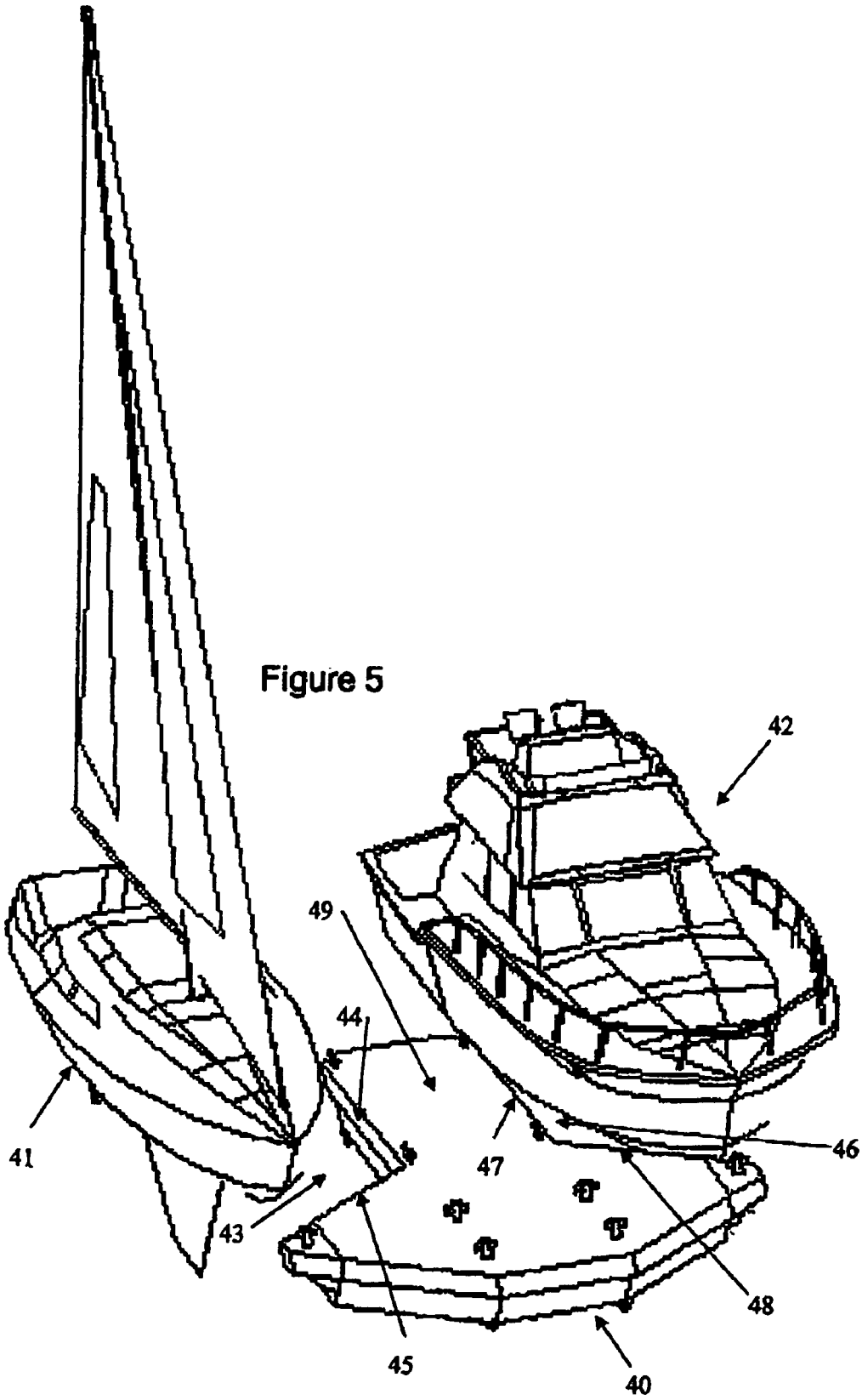
FIG. 5 shows a typical mooring according to one embodiment with two boats attached.

FIG. 5 shows a perspective view of a typical mooring element 40 according to one embodiment with two boats 41 and 42 attached. At least part of the hull of boat 41 is disposed within recess 43 defined by edges 44 and 45. Similarly at least part of a hull of boat 42 is disposed in recess 46 defined by edges 47 and 48. In a typical arrangement, mooring element 40 will be retained by an under pontoon mooring apparatus connected to a spreader plate in a like arrangement to the spreader plate 31 described with reference to FIG. 4, which enables the element to move in a 360 degree circumference. Mooring element 40 will generally (where there is minor current flow) point to windward but the wind direction will dictate its compass direction particularly where vessels are attached. Known swing moorings provide for attachment of only one boat and although it might be conceivable that two boats could be connected to one mooring by rafting up, this would be entirely impractical as there are no satisfactory means for separating the craft to keep them parallel and to prevent lateral impact damage which would be occasioned by strong winds and rough waters. Mooring element 40 includes spacer 49 providing separation between boats 41 and 42 so as to minimize or eliminate the risk of engagement irrespective of the prevailing whether conditions or sea state. Mooring element 40 thus allows mooring of two boats in substantially the same water area previously taken up by single swing moorings. This allows increased boat mooring in a given area in comparison to the number of boats that could be moored in the same area suing prior art moorings.

One advantage of the swing moorings described herein is that loads and stresses normally applied to a boat hull particularly at the bow when moored, will be spread over the part of the boat most able to withstand such stresses. Mooring 40 may be constructed from a variety of materials including plastics, concrete, metal, composite, wood or any material capable of floatation but sufficiently strong to be capable of withstanding lateral impact loads and possible shock loads imposed by concurrent heaving against spacer 49. According to one embodiment, mooring element 40 is manufactured in a mold from plastics, concrete or compound rubber or reinforced rubber. Alternatively the mooring element is manufactured by constructing a space frame of a predetermined shape and applying to the finished space frame a water tight cladding to ensure maintenance of buoyancy.

Modifications may be made to the pontoon according to required changes in buoyancy, stability displacement and strength. The size and configuration may be varied to accommodate various designs for vessels of different sizes LOA (length all over) and displacements. According to one embodiment a single mooring will accommodate vessels the majority of which fall within the 5.0 m-12 m range, but it will be appreciated that the mooring may be adapted to accommodate vessels of sizes outside that range. The mooring will typically include fendering, horn cleats, bollards, hatches mooring lines. Vessels are typically attached to pontoons via use of mooring lines to bollards and horn cleats or other attachments fixed to the deck of the pontoon.

Figure 6:
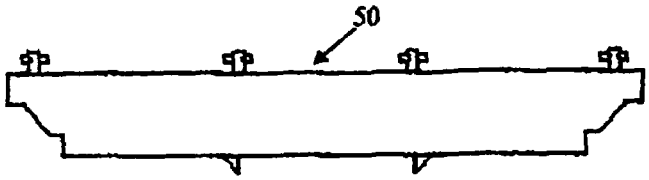
FIG. 6 shows a cross sectional elevation of a mooring pontoon taken at line X-X as shown in FIG. 6*a;*
Figure 6A:
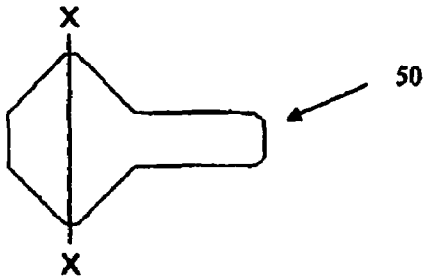
Figure 7:
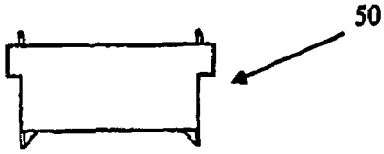
FIG. 7 shows a cross sectional elevation of a mooring pontoon taken at line X-X as shown in FIG. 7*a;*
Figure 7A:
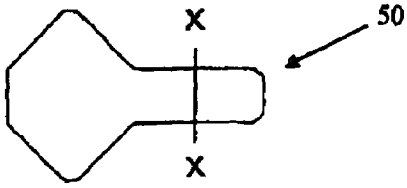
Figure 8:
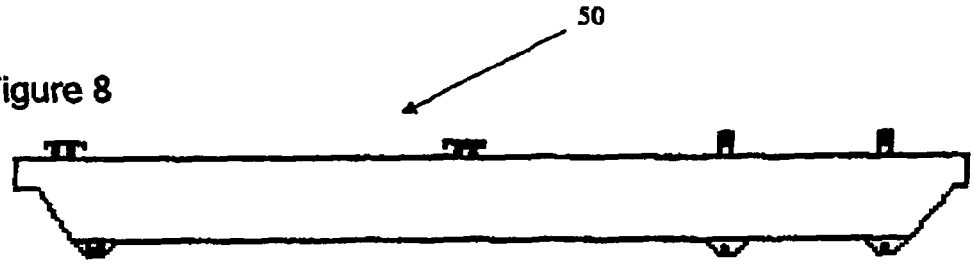
FIG. 8 shows a long sectional election of a mooring pontoon taken at line X-X as shown in FIG. 8*a;*
Figure 8A:
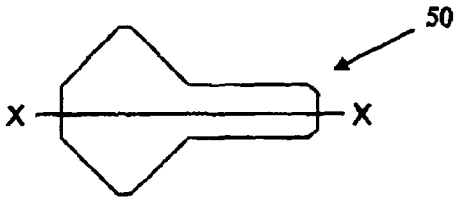
Figure 9:
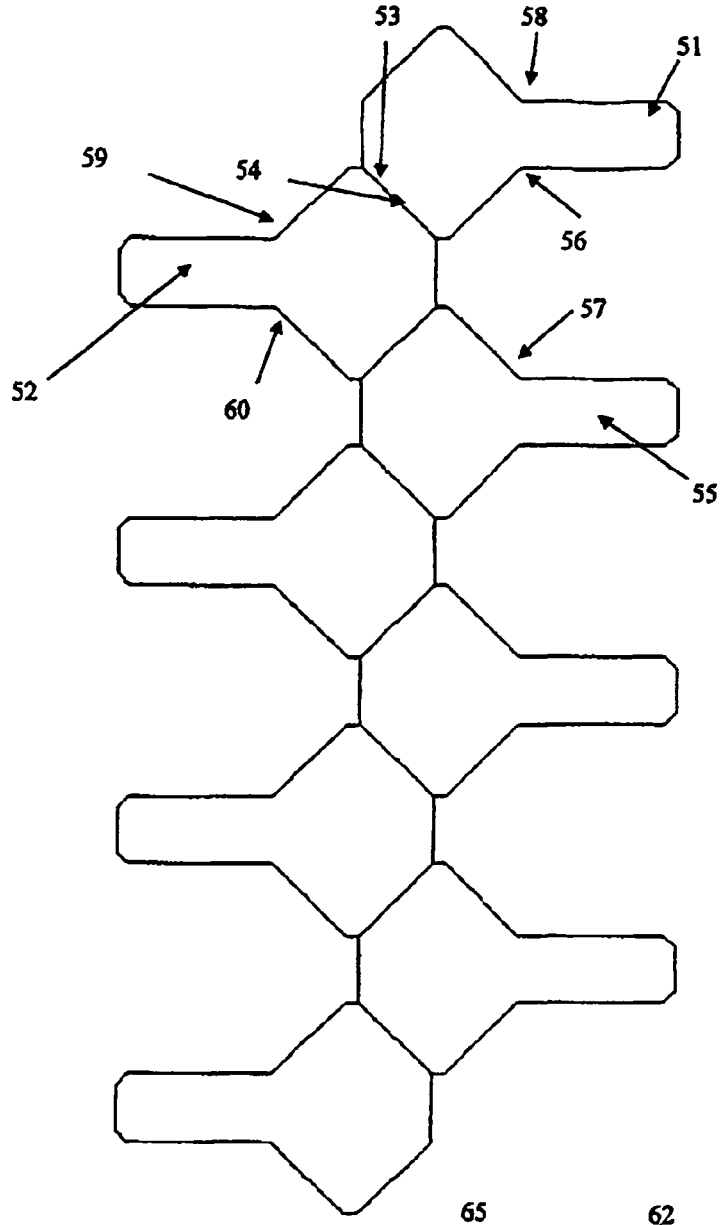
FIG. 9 shows a plan view of a mooring assembly according to one embodiment, formed by a plurality of mooring elements.

FIG. 6 shows a cross sectional elevation of a typical mooring pontoon 50 taken at line X-X as shown in FIG. 6*a*. FIG. 7 shows a cross sectional elevation of mooring pontoon 50 taken at line X-X as shown in FIG. 7*a*. FIG. 8 shows a long sectional elevation of mooring pontoon 50 taken at line X-X as shown in FIG. 8*a*. FIG. 9 shows a plan view of a mooring assembly according to one embodiment, formed by a plurality of like mooring elements. According to the embodiment shown, mooring element 51 engages mooring element 52 via outside opposing splay edges 53 and 54 of elements 51 and 52 respectively. This arrangement places the longitudinal axis of engaging mooring elements out of phase but parallel. Mooring elements 51, 52 and 55 are, according to the embodiment shown arranged so as to form mooring recesses 56-60. Recess 56 and 57 will combine to allow mooring of two small boats or one large boat. Similarly, recesses 58-60 will allow mooring of one boat. This arrangement is repeated along the length of the mooring assembly.

Figure 10:
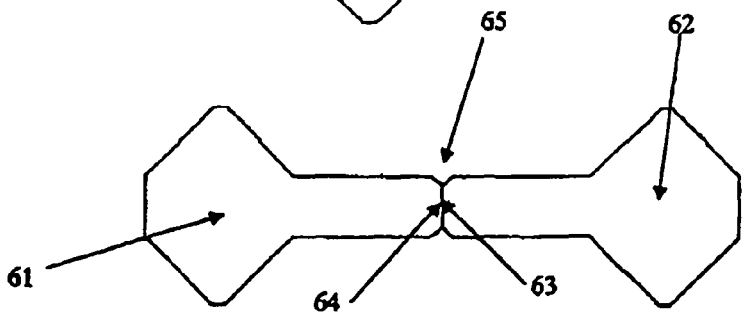
FIG. 10 shows a plan view of a mooring assembly according to an alternative embodiment in which elements are disposed end on end.
Figure 11:
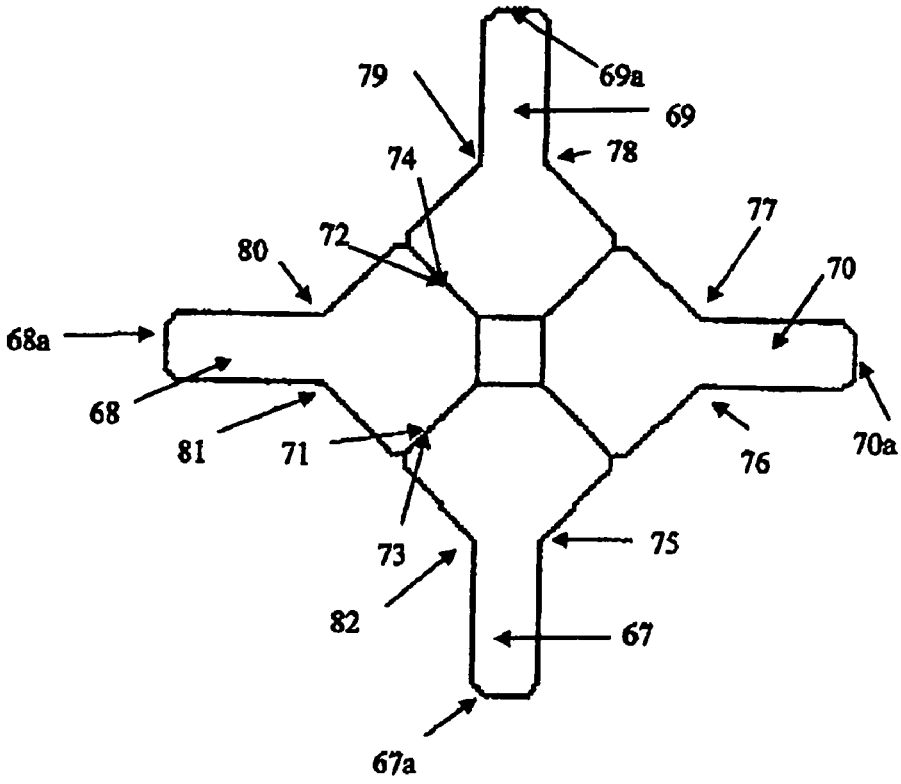
FIG. 11 shows a plan view of a mooring assembly according to an alternative embodiment, formed by a plurality of mooring elements.

FIG. 10 shows a plan view of a mooring assembly according to an alternative embodiment, formed by a plurality of like mooring elements. According to the embodiment shown, mooring element 61 engages mooring element 62 via respective trailing ends 63 and 64. Mooring elements 61 and 62 are, according to the embodiment shown arranged so as to form mooring recesses 65 and 66. Recesses 65 and 66 will allow mooring of two small boats or one large boat. This arrangement may be repeated to enlarge the mooring assembly. In an alternative embodiment the pontoon may be tied to a wharf as a fixture or tether from a trailing end to allow swinging FIG. 11 shows a plan view of a mooring assembly according to an alternative embodiment, formed by a plurality of like mooring elements. According to the embodiment shown, mooring elements 67, 68, 69 and 70 engage so that they are disposed radially. Each element engages two adjacent elements via opposing outside splay edges. For instance, mooring element 68 engages elements 67 and 69 via splay edges 71 and 72. These edges oppose corresponding edges 73 and 74 of elements 67 and 69 respectively. This arrangement places the longitudinal axis of each engaging mooring element normal to at least two adjacent elements and in alignment with at least one other element. A further arrangement for a mooring assembly may be obtained by a combination of the assemblies of FIGS. 10 and 11. Mooring elements 67-70 are, according to the embodiment shown arranged so as to form mooring recesses 75-82. Recesses 75-82 will combine to allow mooring of one boat per recess so at least 8 boats may be accommodated in the assembly of FIG. 11. This arrangement may be repeated to form a larger mooring assembly which engages via one of trailing ends 67*a*-70*a*.

Figure 12:
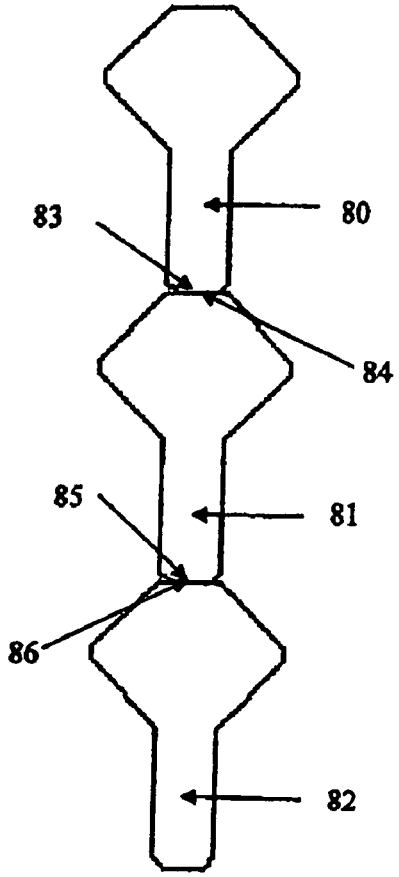
FIG. 12 shows a plan view of a mooring assembly according to a further embodiment, formed by a plurality of mooring elements disposed so that a leading end engages a trailing end of an adjacent element.

FIG. 12 shows a plan view of a mooring assembly according to a further embodiment, formed by a plurality of like mooring elements 80, 81 and 82 joined end to end. According to the embodiment shown, mooring element 80 engages mooring element 81 via trailing end 83 of element 80 and leading end 84 of element 81. Similarly, mooring element 81 engages mooring element 82 via trailing end 85 of element 81 and leading end 86 of element 82.

It will be appreciated that the mooring assemblies described with reference to FIGS. 9-12 are non limiting examples and it will be appreciated that a wide variety of alternative arrangements and means of fixation are possible.

Figure 13:
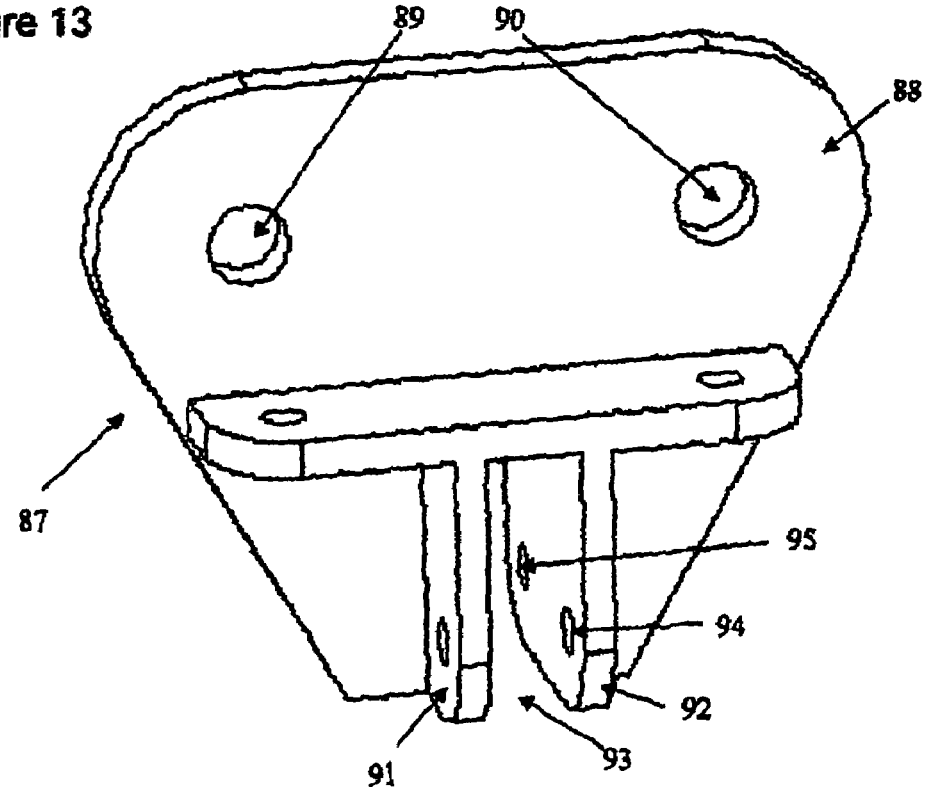
FIG. 13 shows a perspective view of a spreader plate according to one embodiment.
Figure 14:
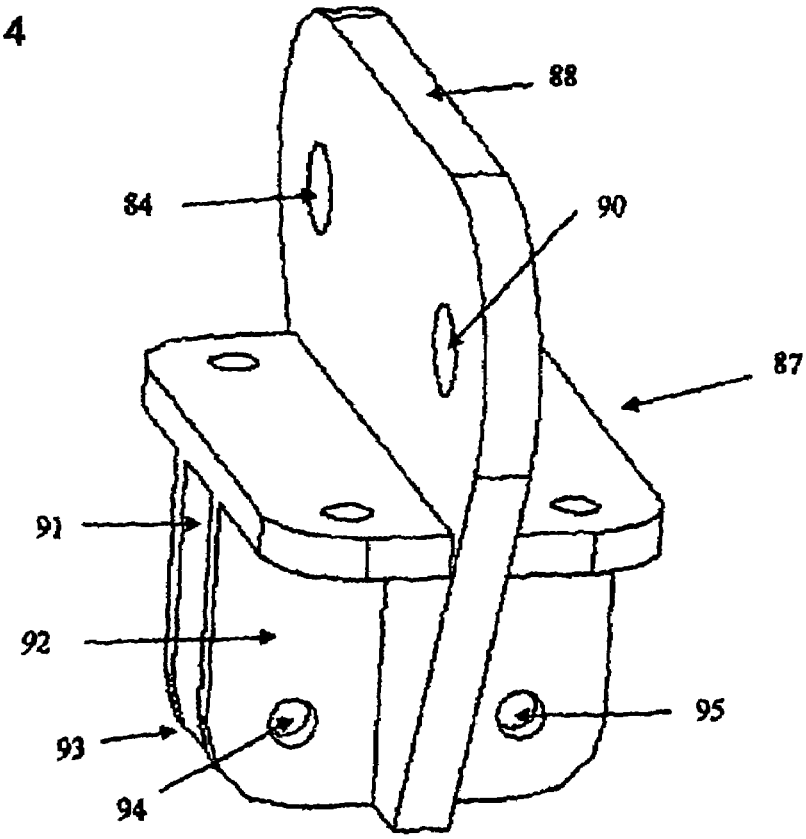
FIG. 14 shows a perspective view of the spreader plate of FIG. 13.

FIG. 13 shows a front perspective view of a spreader plate 87 according to a preferred embodiment. Plate 87 includes outer frame 88 including openings 89 and 90 which receive anchor ropes, webbing or chain (see FIG. 4). Plate 87 further comprises jaws 91 and 92 which define recess 93. Recess 93 receives a shackle, thimble or other known fastening device (not shown) which is fastened to plate 87 via 94 and/or 95 as shown in FIG. 14. Openings (not shown) corresponding to openings 94 and 95 are located in jaw 91 to allow for double shear connections of a fastener such as a shackle.

A mooring pontoon may be attached to a mooring chain, ropes or straps from bollards on the pontoon deck in accordance with current practice but mooring from the underside reduces the possibility of a boat hitting the under mooring pontoon apparatus There are numerous advantages associated with the use of the swing mooring pontoon according to the invention herein described. The major advantage is that it allows two vessels to be moored in an area that currently accommodates only one vessel. This enables two vessels to be moored in half the area they would previously have required with the known swing moorings. This has the effect of reducing boat damage as the number of moorings per boat are reduced. The radius of swing which may be reduced by underwater mooring apparatus thereby provides a greater area for navigation between moorings and moored boats. The swing mooring pontoon can reduce damage to a sea bed environment such as sea grasses and other marine environments. The mooring also allows some boat maintenance to be carried out without having to move the boat to a wharf or slipway, due to walkway access provided by the mooring. The under pontoon moorings also reduce jarring in rough conditions and provide a separation for each vessel. The pontoons according to the invention also provide economic advantages It will be recognized by persons skilled in the art that numerous variations and modifications may be made to the invention as broadly described herein without departing from the overall spirit and scope of the invention.

The invention claimed is:

1. A marine swing mooring capable of anchoring at least marine crafts, the mooring comprising a mooring element constructed to be coupled to an anchor so as to allow said element to swing about said anchor; wherein the element comprises a floating body having a wide leading end and a narrower elongated trailing end; wherein at least part of said element provides a spacer for separating said marine crafts attached to said mooring; and wherein said mooring element causes said two marine crafts to swing in unison responsive to wind or current direction whilst the spacer keeping said marine crafts separated from mutual contact, and wherein the mooring element comprises a floating pontoon including at least one side recess which accommodates at least part of a length of a marine craft attached to said pontoon.

2. A swing mooring according to claim 1, wherein mooring element is substantially T shaped.

3. A swing mooring according to claim 2, wherein a short leg of said T comprises said leading end and a long leg of said T comprises said spacer.

4. A swing mooring according to claim 3, wherein said spacer is constructed to allow connection to either side of said mooring of two boats in spaced apart relationship and at least partially accommodated in respective side recesses, such that as said mooring swings said boats swing while the spacer maintains separation of the boats.

5. A swing mooring according to claim 4, further comprising outside splayed edges disposed adjacent said leading end of each said pontoon and which are capable of engaging an opposing corresponding splay edge of at least one adjacent like pontoon.

6. A swing mooring according to claim 1, wherein at least a portion of the mooring element comprises an internal space frame clad with a waterproof material, and wherein a trailing edge of the pontoon is constructed to engage with a trailing end of a like pontoon to define a substantially 'I' shaped pontoon and providing side recesses capable of accommodating two boats.

7. A swing mooring according to claim 6, wherein, said recesses which accommodate at least part of a boat length are defined by inside splay edges and a lateral edge of said spacer.

8. A swing mooring according to claim 6, wherein said pontoons are disposed in alignment so that a trailing end of one pontoon engages a leading end of an adjacent pontoon, providing four recesses each capable of accommodating a boat.

9. A swing mooring according to claim 6, wherein at least two pontoons are disposed so that outside splay edges of one pontoon engage opposing outside splay edges of adjacent pontoons.

10. A swing mooring according to claim 6, wherein, multiple moorings are arranged so that a longitudinal axis of one pontoon is parallel to a longitudinal axis of at least one other like pontoon.

11. A swing mooring according to claim 1, wherein at least a portion of the mooring element comprises an internal space frame clad with a waterproof material, and wherein multiple pontoons are arranged so that a longitudinal axis of one pontoon is in alignment with a longitudinal axis of at least one other like pontoon and normal to a longitudinal axis of at least one other adjacent pontoon.

12. A marine swing mooring capable of retaining two boats in unison the mooring comprising a generally T shaped body having a leading end and a trailing end, wherein the leading end comprises a head which is connected to an anchor via a tether allowing the mooring freedom to swing at an arc extending from said anchorage; wherein, intermediate said leading end and said trailing end there is provided a spacer having outer lateral edges which are continuous with a corresponding edge on said head to define recesses either side of said spacer each capable of receiving at least part of a boat hull; wherein, said boat hulls are spaced apart preventing unwanted contact between said boat hulls such that both boats are able to swing in unison.

* * * * *